US008997879B2

(12) United States Patent
Derr et al.

(10) Patent No.: US 8,997,879 B2
(45) Date of Patent: Apr. 7, 2015

(54) DIVERTER SPOOL AND METHODS OF USING THE SAME

(75) Inventors: Douglas N. Derr, The Woodlands, TX (US); Patrick M. Ljungdahl, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 693 days.

(21) Appl. No.: 13/224,004

(22) Filed: Sep. 1, 2011

(65) Prior Publication Data

US 2013/0056226 A1 Mar. 7, 2013

(51) Int. Cl.
*E21B 19/00* (2006.01)
*E21B 33/12* (2006.01)
*E21B 43/01* (2006.01)

(52) U.S. Cl.
CPC ..... *E21B 43/0122* (2013.01)

(58) Field of Classification Search
CPC ... E21B 33/035; E21B 33/038; E21B 33/064; E21B 43/0122; E21B 43/013; E21B 17/01
USPC ..... 166/364, 339, 344, 367, 368, 338, 166/250.08, 75.13, 97.1; 405/52, 224.1
See application file for complete search history.

(56) References Cited

U.S. PATENT DOCUMENTS 3,760,889 A * 9/1973 Nelson ..... 175/6
4,147,221 A * 4/1979 Ilfrey et al. ..... 175/7
4,323,118 A * 4/1982 Bergmann ..... 166/96.1
4,382,716 A 5/1983 Miller
4,568,220 A 2/1986 Hickey
6,352,114 B1 * 3/2002 Toalson et al. ..... 166/343
8,136,597 B2 * 3/2012 Calderoni et al. ..... 166/343
8,297,361 B1 * 10/2012 Root ..... 166/364
8,434,557 B2 * 5/2013 Chaddick ..... 166/344
8,434,558 B2 * 5/2013 Swanson et al. ..... 166/368
8,444,344 B2 * 5/2013 Oesterberg et al. ..... 405/60
2013/0056226 A1 * 3/2013 Derr et al. ..... 166/386

FOREIGN PATENT DOCUMENTS

WO 2013032930 A2 3/2013

OTHER PUBLICATIONS

ANSI/API Specification 16A entitled "Specification for Drill-through Equipment" dated Jun. 2004, 122 pages, Third Edition, American Petroleum Insitute.

(Continued)

*Primary Examiner* — Daniel P Stephenson

(57) ABSTRACT

A well containment assembly comprising a first pressure-containing device and a diverter spool. The diverter spool comprises a body having a longitudinal central axis and at least partially defining a primary flowbore, an upper connection assembly coupled to the body, a lower connection assembly coupled to the body, and a plurality of side outlets. Each of the plurality of side outlets has a longitudinal central axis and at least partially defines a secondary flowbore. Each of the plurality secondary flowbores is in communication with the primary flowbore, and the angle between the longitudinal central axis of the body and the longitudinal central axis of the plurality of side outlets is less than 90° with respect to the primary flowbore. The first pressure-containing device is coupled to the diverter spool via the upper connection assembly.

20 Claims, 6 Drawing Sheets

(56) References Cited

OTHER PUBLICATIONS

Transocean Public Report entitled "Macondo Well Incident: Transocean Internal Investigation," Aug. 12, 2011, 2 pages.

Foreign communication from a related counterpart application—International Search Report and Written Opinion, PCT/US2012/052342, Apr. 11, 2013, 10 pages.

* cited by examiner

DIVERTER SPOOL AND METHODS OF USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons are commonly produced from wells that penetrate a subterranean formation, either beneath dry land or beneath a body of water. Within such subterranean formations, massive quantities of fluids and gases, including hydrocarbons, may be present at very high pressures. Therefore, throughout the processes of drilling and completing the well, producing hydrocarbons from the subterranean formation, stimulating the subterranean formation to improve hydrocarbon production therefrom, and/or, ultimately, closing-in and abandoning the well, a variety of measures are employed to maintain control of the well.

Despite efforts to maintain control over a well through the process associated with that well, unforeseen circumstances, equipment failures, or other factors may lead to the loss of control of a well. Loss of well control may result in formation fluids being emitted from the well at uncontrolled flow rates and pressures, thereby posing serious environmental and safety hazards. As such, when control over a well is lost, it is necessary to, as expediently as possible, regain control thereof. Regaining control over a well may necessitate making a suitable connection to a well component in order to cease the uncontrolled escape of formation fluids.

Accordingly, there exists a need for an apparatus for use in regaining control over a well and method of using the same.

SUMMARY

Disclosed herein is a well containment assembly comprising a first pressure-containing device, and a diverter spool, the diverter spool comprising a body having a longitudinal central axis and at least partially defining a primary flowbore, an upper connection assembly coupled to the body, a lower connection assembly coupled to the body, and a plurality of side outlets, each of the plurality of side outlets having a longitudinal central axis and at least partially defining a secondary flowbore, wherein each of the plurality secondary flowbores are in communication with the primary flowbore, and wherein the angle between the longitudinal central axis of the body and the longitudinal central axis of the plurality of side outlets is less than 90° with respect to the primary flowbore, wherein the first pressure-containing device is coupled to the diverter spool via the upper connection assembly.

Also disclosed herein is a method of containing a well comprising providing a well containment assembly comprising a first pressure-containing device, and a diverter spool, the diverter spool comprising a body having a longitudinal central axis and at least partially defining a primary flowbore, an upper connection assembly coupled to the body, a lower connection assembly coupled to the body, and a plurality of side outlets, each of the side outlets having a longitudinal central axis and at least partially defining a secondary flowbore, wherein the each of the secondary flowbores are in communication with the primary flowbore, and wherein the angle between the longitudinal central axis of the body and the longitudinal central axis of the plurality of side outlets is less than 90° with respect to the primary flowbore, wherein the first pressure-containing device is coupled to the diverter spool via the upper connection assembly, placing the well containment assembly in close proximity to an open well such that at least a portion of a fluid escaping from the well is directed into the well containment assembly, and wherein at least a portion of the volume of the fluid directed into the well containment assembly is expelled therefrom via the plurality of side outlets, and connecting the well containment assembly to the well.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1A:
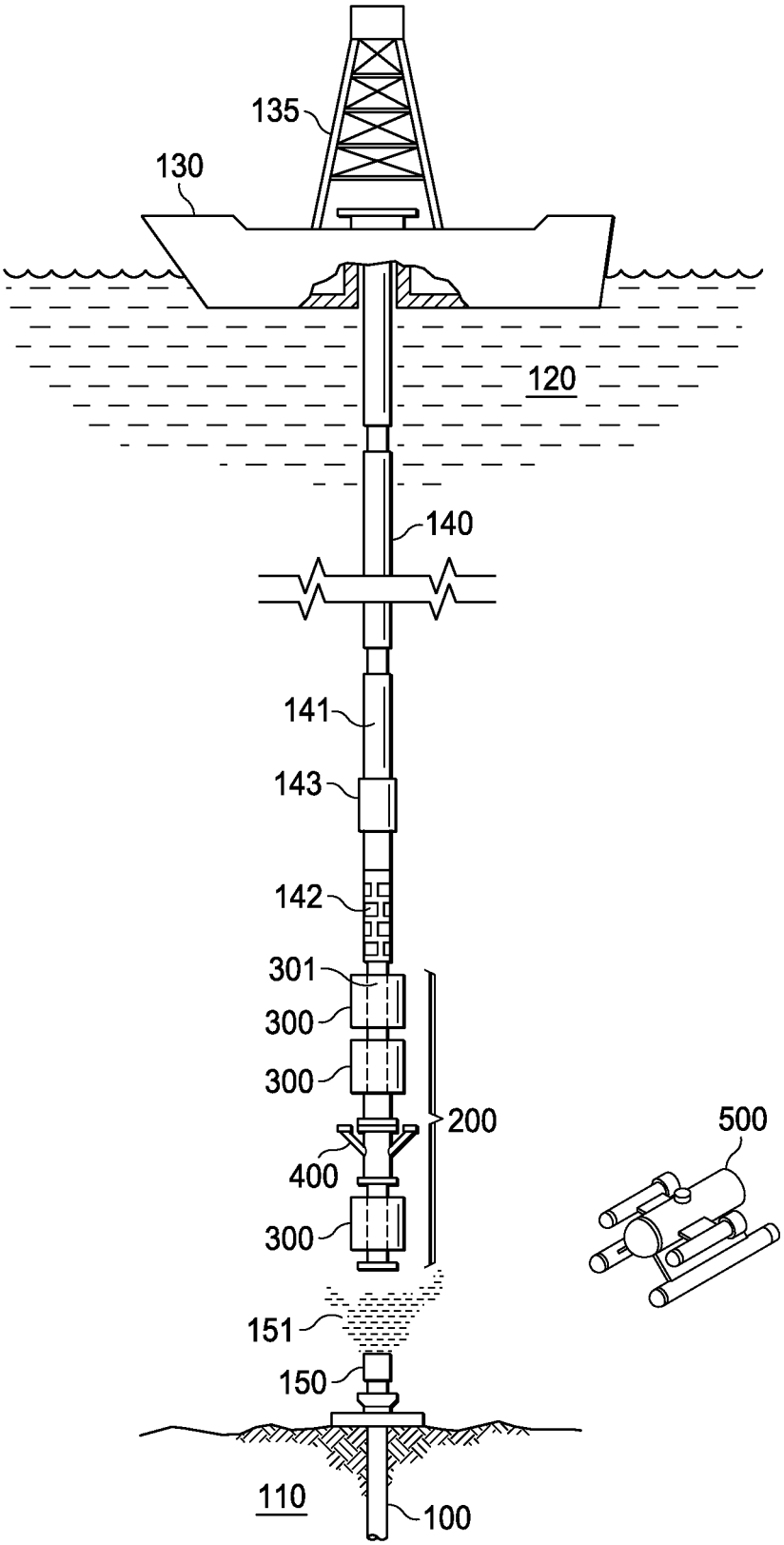
FIG. 1A is a view of an embodiment of a well containment system comprising a diverter spool according to the disclosure and a plurality of pressure containing devices lowered via a drill string.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of well containment assemblies comprising a diverter spool, well containment systems, and methods of using the same. A diverter spool, as disclosed herein, may be employed to divert the flow of a fluid stream while one or more additional components of a well containment system are connected to a well from which the fluid stream is emitted. Also disclosed herein are one or more embodiments of a method of employing a diverter spool to regain control of a well.

Figure 1B:
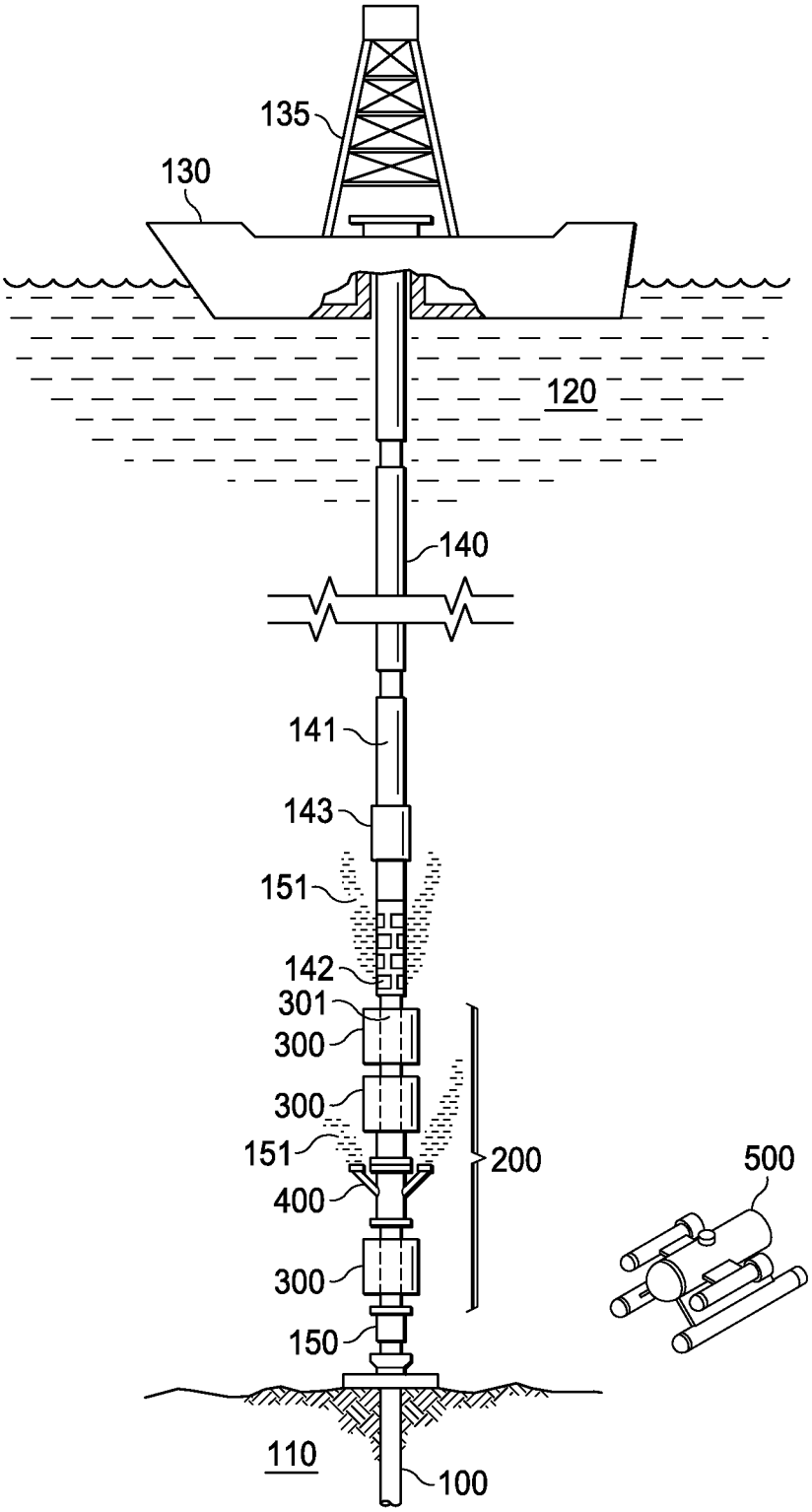
FIG. 1B is a view of an embodiment of the well containment system of FIG. 1A coupled to a well.
Figure 1C:
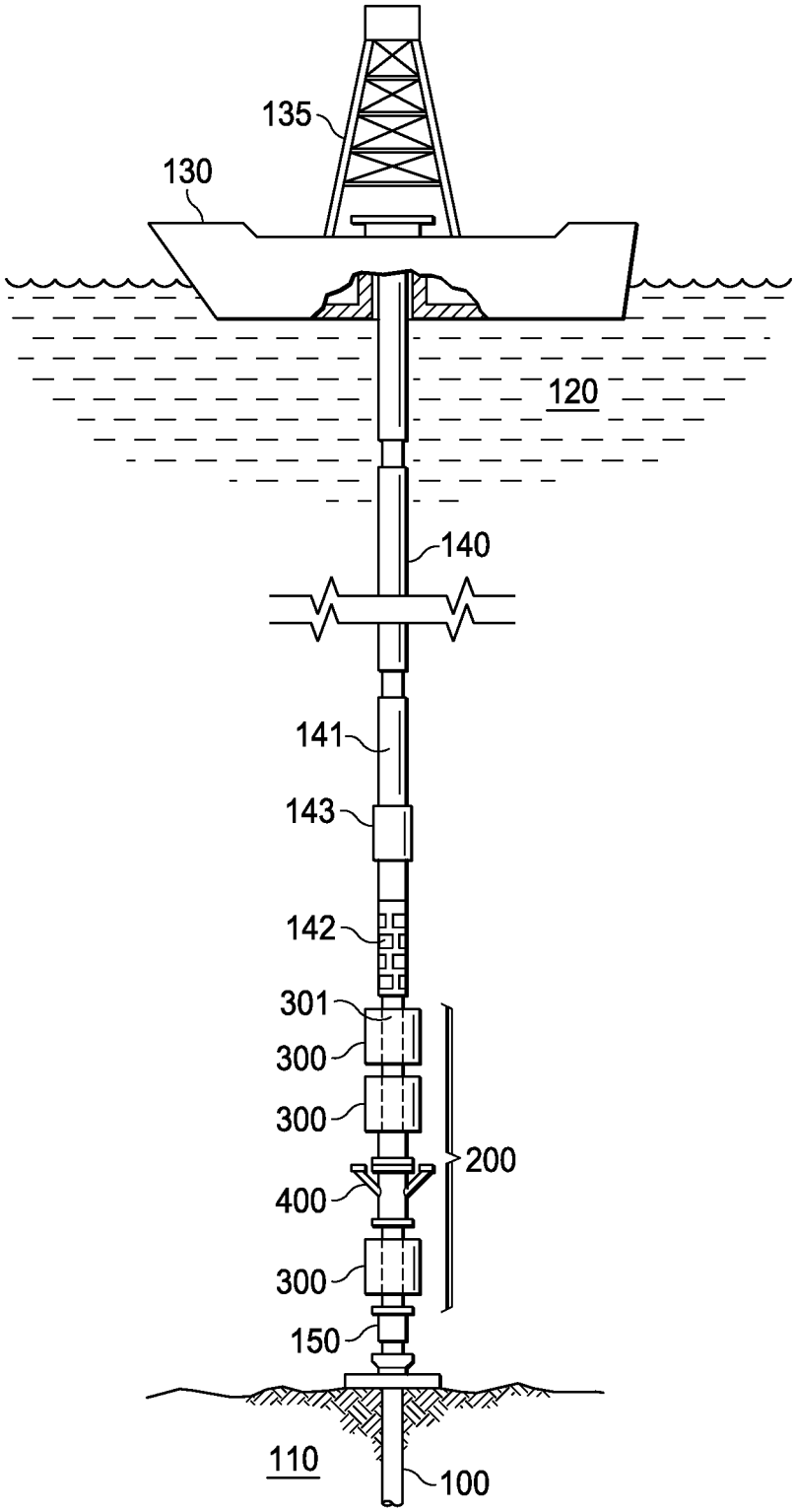
FIG. 1C is a view of an embodiment of the well containment system of FIGS. 1A and 1B employed to gain control of the well.

Referring to FIGS. 1A, 1B, and 1C an embodiment of an operating environment in which such well containment assemblies, systems, and methods may be employed is illustrated. It is noted that although some of the figures may exemplify a subterranean formation beneath a body of water, the principles of the assemblies, systems, and methods disclosed herein may be similarly applicable to the subterranean formation beneath dry land. Therefore, the location of the subterranean formation illustrated in the figure is not to be construed as limiting. It is noted that although some of the figures may exemplify horizontal or vertical wellbores, the principles of the assemblies, systems, and methods disclosed herein may be similarly applicable to horizontal wellbore configurations, conventional vertical wellbore configurations, and combinations thereof. Therefore, the horizontal or vertical nature of any figure is not to be construed as limiting.

As depicted in FIGS. 1A, 1B, and 1C, the operating environment generally comprises a wellbore 100 that penetrates a subterranean formation 110 for the purpose of recovering hydrocarbons, storing hydrocarbons, disposing of carbon dioxide, or the like. The wellbore 100 may extend substantially vertically over a vertical portion of the wellbore 100 or may deviate at any angle from the earth's surface over a deviated or horizontal portion of the wellbore 100. In alternative operating environments, all or portions of the wellbore 100 may be vertical, deviated, horizontal, and/or curved. The wellbore 100 may be drilled into the subterranean formation 110 using any suitable drilling technique. For example, a drilling, servicing, and/or production rig 135 may be located on a platform 130 (e.g., a drilling, servicing, and/or production platform) at the surface of a body of water 120 may be employed to drill and/or service the wellbore 100 and/or produce hydrocarbons therefrom. A tubing string 140 (e.g., a riser, a drilling string, and/or a production string) may extend beneath the platform 130 to the seafloor to provide a connection to a wellhead 150 which may provide a connection to the wellbore 100. Various subsea equipment, for example, pipelines, end templates, manifolds, blowout preventers, risers, and the like may be located at the seafloor proximate to the wellhead 150, associated with the wellhead 150 and/or in fluid communication with the wellhead 150.

Referring again to FIG. 1A, where the wellhead 150 and/or any of the equipment associated therewith has become damaged or has failed, a stream 151 of fluids may escape into the surrounding environment. Prior to and/or following removal of the damaged components, as disclosed herein, the fluid stream 151 may continue to escape into the surrounding environment, for example, in the embodiment of FIG. 1A, into the surrounding body of water 120. The stream 151 may comprise fluid or gaseous hydrocarbons, water, paraffins, salts, and the like escaping the wellhead 150 and/or the associated equipment in a relatively high rate and/or pressure.

In the embodiment of FIGS. 1A, 1B, and 1C, a well containment assembly (WCA) 200 is lowered into the body of water 120 suspended from a tubing string 140. In such an embodiment, the tubing string 140 may comprise an axial flowbore 141 and may be in fluid communication with one or more components of the WCA 200. In an embodiment, the tubing string 140 may comprise a plurality of ports and/or windows 142 configured to disperse fluid pressure from the axial flowbore 141 of the tubing string 140; alternatively, ports and/or windows may be absent from the tubing string 140. In the embodiment of FIGS. 1A, 1B, and 1C, the WCA 200 generally comprises three pressure containment devices (PCDs) 300 and a diverter spool 400, as will be discussed herein. Although the WCA 200 of FIGS. 1A, 1B, and 1C comprises three PCDs, one of skill in the art viewing this disclosure will recognize that any suitable number of such PCDs may be employed. Further, although the WCA 200 of FIGS. 1A, 1B, and 1C comprises two PCDs 300 above the diverter spool 400 and a single PCD 300 below the diverter spool 400, one of skill in the art viewing this disclosure will recognize that PCDs may be employed above or below the diverter spool in any suitable configuration, as may be dependent upon the wishes of the operator and the conditions of a particular job.

In an embodiment, the PCDs 300 may generally comprise an assemblage of equipment configured to prevent uncontrolled fluid flow and/or pressure emanating from a wellbore during a drilling, servicing, production, or other phase with respect to a well. The PCDs may comprise a flowbore 301 extending therethrough. An example of a suitable PCD includes, although is not limited to, a blowout preventer stack (BOP stack). A BOP stack generally refers to an assemblage comprising one or more valves and/or devices configured to cease fluid movement via a flowpath upon actuation. As will be appreciated by one of skill in the art, a BOP stack may be configured to confine fluids to the well, to provide a means by which additional fluids may be introduced into the wellbore, protect equipment associated with a well, to allow controlled volumes of fluid to be withdrawn from the well, to regulate pressure within the well, to seal the well, sever the casing or drill pipe in case of emergencies, or combinations thereof. A suitable BOP stack may comprise one or more ram BOPs or "rams," such as pipe rams, blind rams, shear rams, blind shear rams, one or more annular BOPs, or combinations thereof. Control of one or more components of a given BOP stack may be manual, automated, or combinations thereof and may occur hydraulically, electrically, mechanically, or combinations thereof.

Figure 2:
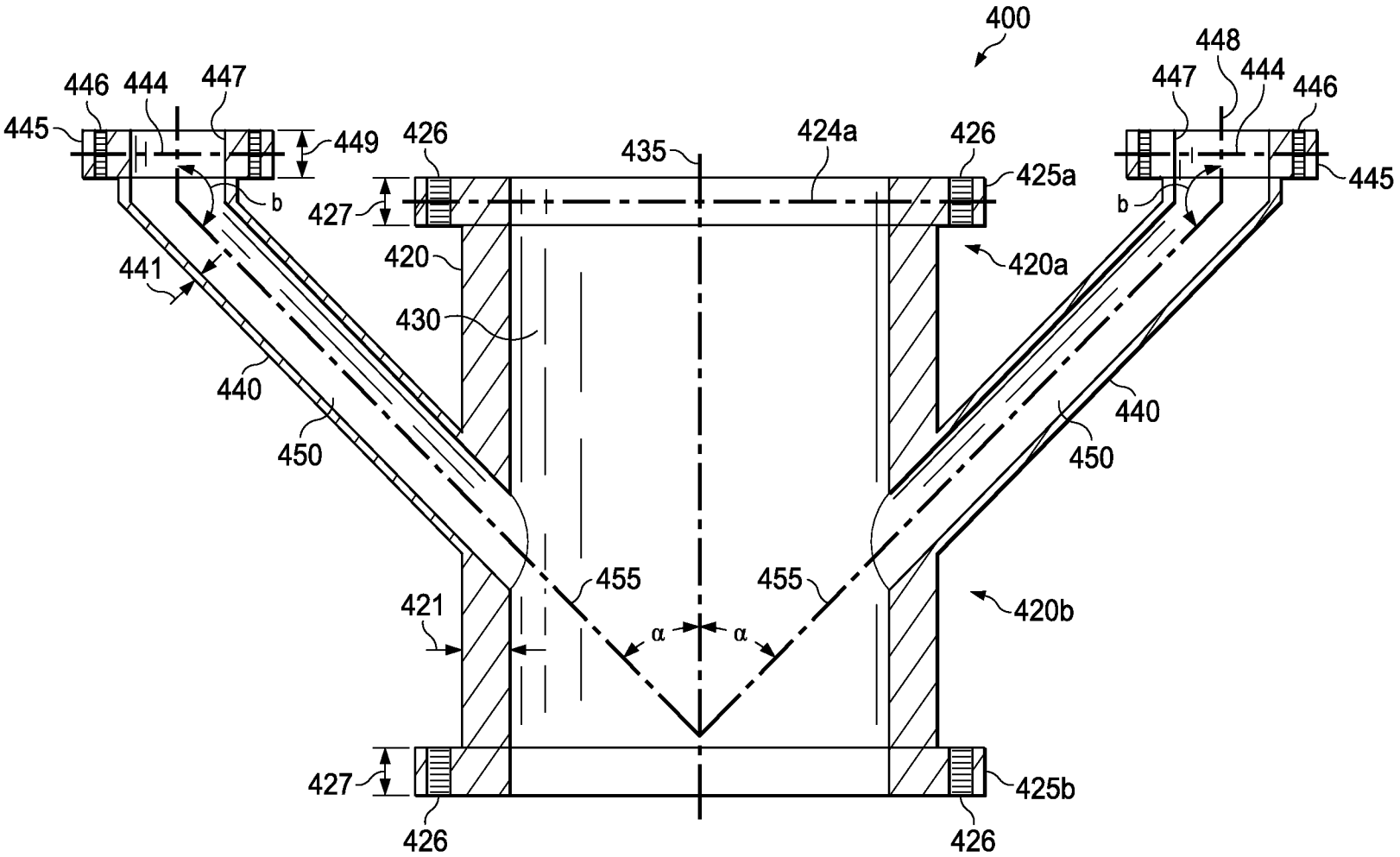
FIG. 2 is a cross-sectional view of the diverter spool of FIGS. 1A, 1B, and 1C.

Referring to FIG. 2, an embodiment of a diverter spool 400 is illustrated. In the embodiment of FIG. 2, the diverter spool generally comprises a body 420 and a plurality (e.g., two or more) side outlets 440. In an embodiment, the diverter spool 400 generally comprises a structure or combination of structures configured to withstand and divert the path of a high-pressure, high flow rate fluid stream, such as fluid stream 151. In an embodiment, the diverter spool 400 may comprise a unitary structure. In such an embodiment, the diverter spool 400 may be formed as a single piece via a suitable process. In an alternative embodiment, the diverter spool 400 may comprise two or more operably connected components. In such an embodiment, each of the two or more coupled sub-components may be formed via suitable process and joined by suitable connection. For example, two or more components may be joined via a welded, threaded, flanged, or the like connection.

In an embodiment, the components of the diverter spool 400, as disclosed herein, may be characterized as exhibiting a pressure tolerance greater than a suitable threshold. For example, the diverter spool may be able to withstand a fluid pressure of at least 10,000 psi, alternatively, at least 12,000 psi, alternatively, at least 14,000 psi, alternatively, at least 16,000 psi, alternatively, at least 18,000, psi, alternatively, at least 20,000 psi, that is applied to an interior flowbore thereof. As will be appreciated by one of skill in the art, the fluid pressure that the diverter spool is able to withstand may be a product of the material(s) employed to form the components of the diverter spool 400, the method employed in forming the diverter spool 400, the thickness of the material(s) employed to form the diverter spool 400, and the like, as will be discussed herein.

In an embodiment, the diverter spool 400 and/or one or more of the components thereof may be formed from a suitable material. Examples of such a suitable material include, but are not limited to, steel and other metallic alloys. For example, in an embodiment the diverter spool 400 and/or one or more of the components thereof may be formed from a material as described by the Material Specifications set out in API Specifications 6A, 16A, and 17 and/or as described by the National Association of Corrosion Engineers (NACE) MR 0175. In an embodiment, the body may be formed by suitable process. Examples of such a suitable process include, but are not limited to, casting, forging, extrusion, or combinations thereof.

In an embodiment, the body 420 generally comprises a tubular structure at least partially defining a primary flowbore 430 extending therethrough and having a longitudinal central axis 435. In an embodiment, the body 420 may be characterized as comprising a generally upper end 420*a* and a generally lower end 420*b*.

In an embodiment, the body 420 may be characterized as having a suitable inside diameter. For example, the body 420 may have an inner bore diameter of about 2.0625 in., 3.0625 in., 4.0625 in., 5.1250 in., 7.0625 in., 11.0000 in., 13,6250 in., 16.7500 in., 18.7500 in., 21.2500 in., or any other suitable size, as will be appreciated by one of skill in the art viewing this disclosure. In an embodiment, the primary flowbore 430 may be characterized as having a suitable flow area. As used herein "flow area" is used to refer to the cross-sectional area of the flowbore in the axes perpendicular to the longitudinal central axis of that flowbore. As will be appreciated by one of skill in the art viewing this disclosure, the flow area may be a product of the inside diameter of the body 420. For example, the flow area may be in a range of from about 3.00 in. to about 360.00 in.

In an embodiment, the body 420 comprises an upper connection assembly 425*a* and a lower connection assembly 425*b*. The upper connection assembly 425*a* and/or the lower connection assembly 425*b* may generally comprise a structure configured to allow connection between the body 420 and an additional component, for example, a PCD as disclosed herein, a pipeline, a wellhead, a riser, a pipe joint, or the like. Additionally, the connection assemblies 425*a* and/or 425*b* may be configured for connection via the operation of a remotely-operated vehicle (ROV), for example, an underwater ROV 500. The upper connection assembly 425*a* and/or the lower connection assembly 425*b* may comprise a bore having substantially the same inner diameter as that of the remainder of the body 420. In the embodiment of FIG. 2, the upper connection assembly 425*a* and the lower connection assembly 425*b* each comprise a flange. In such an embodiment, the flanges may be configured for connection to another flange. For example, the flanges may comprise boreholes 426 each configured to receive a bolt. In an embodiment, the boreholes 426 may be internally threaded. Alternatively, the boreholes 426 may comprise a smooth inner bore.

In an embodiment, the body 420 and/or the components thereof may be formed in a suitable thickness. For example, in an embodiment the thickness of the walls 421 of the body 420 may be in a range of from about 1.00 in. to about 8.00 in., alternatively, from about 1.15 to about 6.50 in., alternatively, from about 1.25 to about 6.125 in. In an embodiment, the thickness of the walls may be dependent upon and/or related to in the inner diameter of the body 420. For example, an inner bore size of about 2.0625 in. may be associated with a wall thickness of about 1.1563 in., alternatively, an inner bore size of about 3.0625 in. may be associated with a wall thickness of about 1.500 in., alternatively, an inner bore size of about 4.0625 in. may be associated with a wall thickness of about 1.8125 in., alternatively, an inner bore size of about 5.1250 in. may be associated with a wall thickness of about 1.8438 in., alternatively, an inner bore size of about 7.0625 in. may be associated with a wall thickness of about 2.8750 in., alternatively, an inner bore size of about 11.0000 in. may be associated with a wall thickness of about 6.0000 in., alternatively, an inner bore size of about 13.6250 in. may be associated with a wall thickness of about 4.9063 in., alternatively, an inner bore size of about 16.7500 in. may be associated with a wall thickness of about 4.5313 in., alternatively, an inner bore size of about 18.7500 in. may be associated with a wall thickness of about 5.4375 in., alternatively, an inner bore size of about 21.2500 in. may be associated with a wall thickness of about 6.0625 in. Alternatively, any suitable thickness of wall may be employed, as will be appreciated by one of skill in the art viewing this disclosure.

Also, in an embodiment the thickness 427 of the upper connection assembly and/or the lower connection assembly 425*a*/425*b* may be in a range of from about 1.00 in. to about 10.00 in., alternatively, from about 2.00 to about 9.50 in., alternatively, from about 2.25 to about 8.75 in. In an embodiment, the thickness of a connection assembly may be dependent upon and/or related to in the inner diameter of the body 420. For example, an inner bore size of about 2.0625 in. may be associated with a connection assembly thickness of about 2.000 in., alternatively, an inner bore size of about 3.0625 in. may be associated with a connection assembly thickness of about 2.53125 in., alternatively, an inner bore size of about 4.0625 in. may be associated with a connection assembly thickness of about 3.094 in., alternatively, an inner bore size of about 5.1250 in. may be associated with a connection assembly thickness of about 3.25 in., alternatively, an inner bore size of about 7.0625 in. may be associated with a connection assembly thickness of about 4.6875 in., alternatively, an inner bore size of about 11.0000 in. may be associated with a connection assembly thickness of about 7.375 in., alternatively, an inner bore size of about 13.6250 in. may be associated with a connection assembly thickness of about 7.875 in., alternatively, an inner bore size of about 16.7500 in. may be associated with a connection assembly thickness of about 6.625 in., alternatively, an inner bore size of about 18.7500 in. may be associated with a connection assembly thickness of about 8.78125 in., alternatively, an inner bore size of about 21.2500 in. may be associated with a connection assembly thickness of about 9.500 in. Alternatively, any suitable thickness of connector assembly may be employed, as will be appreciated by one of skill in the art viewing this disclosure.

In an embodiment, each of the side outlets 440 generally comprises a tubular structure at least partially defining a secondary flowbore 450 extending therethrough having a longitudinal central axis 455. The secondary flowbores 450 may intersect and be in fluid communication with the primary flowbore 430.

In an embodiment, the side outlets 440 may be present in a given number and in a given arrangement. In the embodiment of FIG. 2, the diverter spool 400 comprises two side outlets 440 separated radially by approximately 180° with respect to the axial flowbore 435 and intersecting the diverter spool body 420 at approximately the same longitudinal distance along the body 420. In an alternative embodiment, a diverter spool 400 may comprise 3, 4, 5, 6, or more side outlets. In an embodiment, the side outlets 440 may be spaced about the diverter spool body 420 radially, longitudinally, or both radially and longitudinally. For example, the side outlets 440 may intersect the body 420 in a symmetric, staggered, corkscrew, or other pattern or in no pattern at all (e.g., a random, non-uniform, or asymmetric arrangement). The side outlets 440 may intersect the body 420 at a suitable distance along the body 420.

In an embodiment, each of the side outlets 440 may be characterized as having a suitable inside diameter. For example, the side outlets 440 may have an inner bore diameter of about 2.0625 in., 3.0625 in., 4.0625 in., 5.1250 in., 7.0625 in., 11.0000 in., 13,6250 in., 16.7500 in., 18.7500 in., or any other suitable size, as will be appreciated by one of skill in the art viewing this disclosure. In an embodiment, the inner bore diameter of the side outlets 440 may be dependent upon the inner bore diameter of the body 420. For example, a diverter spool have with a body having an inner bore diameter of about 7.0625 in. may comprise side outlets having an inner bore diameter of about 4.0625 in. Also, for example, a diverter spool have with a body having an inner bore diameter of about 18.7500 in. may comprise side outlets having an inner bore diameter of about 7.0625 in. In an embodiment, each of the secondary flowbores 450 may be characterized as having a suitable flow area. As noted above, as used herein "flow area" is used to refer to the cross-sectional area of the flowbore in the axes perpendicular to the longitudinal central axis of that flowbore. As will be appreciated by one of skill in the art viewing this disclosure, the flow area may be a product of the inside diameter of the side outlets 440.

Figure 4:
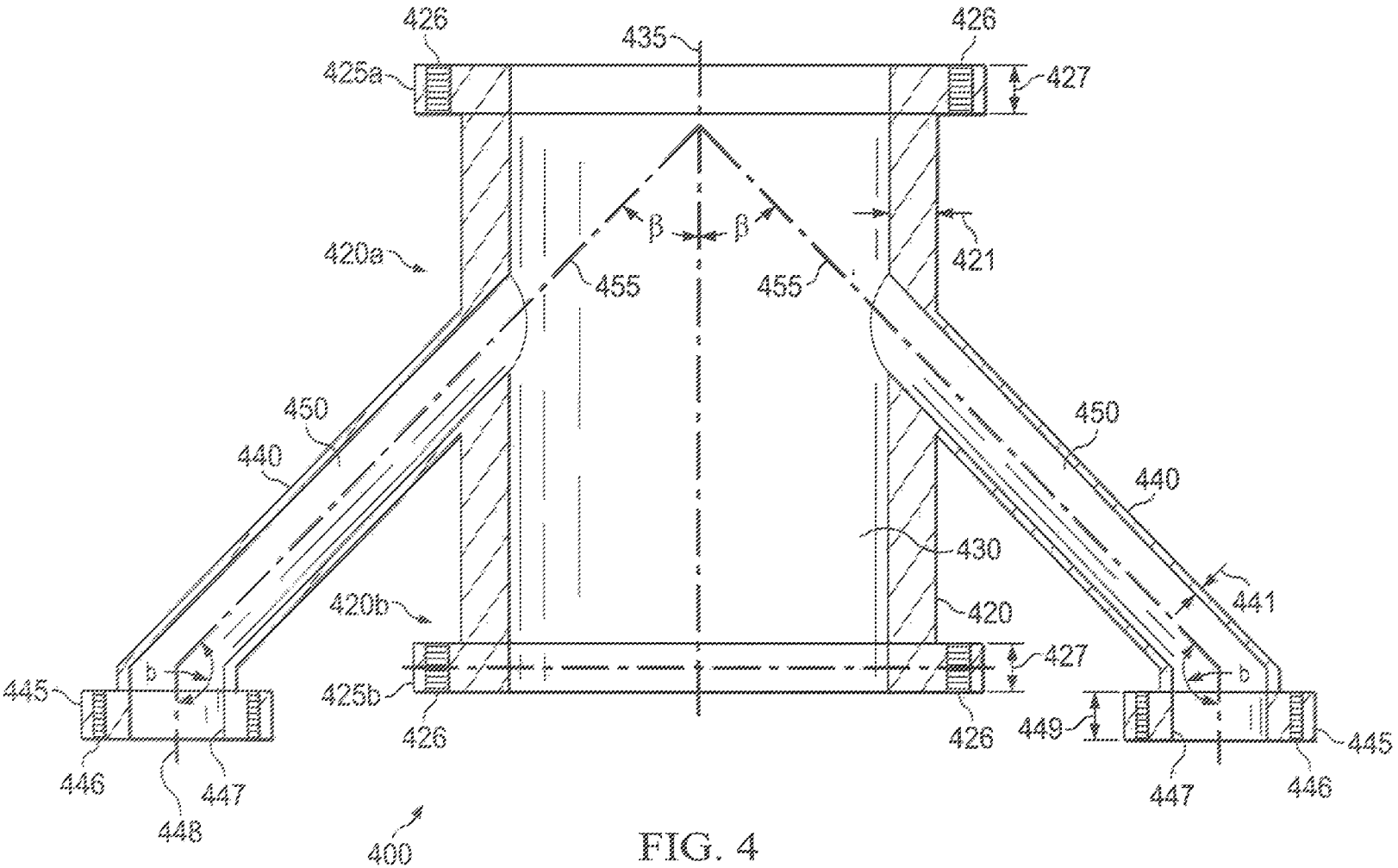
FIG. 4 is a cross-sectional view of an alternative embodiment of a diverter spool.

In an embodiment, each of the side outlets 440 may extend away from the body 420 at an angle less than 90°. Referring to FIG. 2, each of the side outlets 440 extends generally upward and outward away from the body 420. In the embodiment of FIG. 2, an angle, designated as α, formed at the intersection of i) a ray coaxial with the longitudinal central axis 435 of the primary flowbore 430 extending from the point of intersection toward the upper end 420*a* of the body 420 and ii) a ray coaxial with the longitudinal central axis 455 of the secondary flowbore 450 extending from the point of intersection outward ma be less than 90°, alternatively, less than about 80°, alternatively less than about 70°, alternatively, less than about 60°, alternatively, less than about 50°, alternatively, less than about 40°, alternatively about 45°. Referring to FIG. 4, in an alternative embodiment, each of the side outlets may extend generally downward and outward away from the body. In such an embodiment, an angle, designated as β, formed at the intersection of a) a ray coaxial with the longitudinal central axis 435 of the primary flowbore 430 extending from the point of intersection toward the lower end 420*b* of the body 420 and b) a ray coaxial with the longitudinal central axis 455 of the secondary fiowbore 450 extending from the point of intersection outward may be less than 90°, alternatively less than about 80°, alternatively, less than about 70°, alternatively, less than about 60°, alternatively, less than about 50°, alternatively, less than about 40°, alternatively, about 45°. In still another embodiment, a first of the side outlets may extend generally upward and outward away from the body while a second of the side outlets may extend generally downward and outward away from the body, for example, at an angle as disclosed herein. Not intending to he bound by theory, it is theorized that the capability of the diverter spool disperse fluid pressure andlor fluid flow may be improved where the secondary flowbores 450 deviate from the primary flowbore 430 at a lesser angle.

In an embodiment, each of the side outlets 440 comprises a secondary connection assembly 445. The secondary connection assembly 445 may generally comprise a structure configured to allow connection between the side outlet 440 and an additional component, such as a valve or other pressure/flow containing and/or controlling device. Additionally, the connection assemblies 445 may be configured for connection via the operation of an ROV. The secondary connection assembly 445 may comprise a flowbore 447 having a longitudinal central axis 448 and having substantially the same inner diameter as that of the remainder of the side outlet 440. In the embodiment of FIG. 2, the secondary connection assemblies 445 each comprise a flange. In such an embodiment, the flanges may be configured for connection to another flange. For example, the flanges may comprise boreholes 446 each configured to receive a bolt. In an embodiment, the boreholes 446 may be internally threaded. Alternatively, the boreholes 426 may comprise a smooth inner bore.

Figure 3:
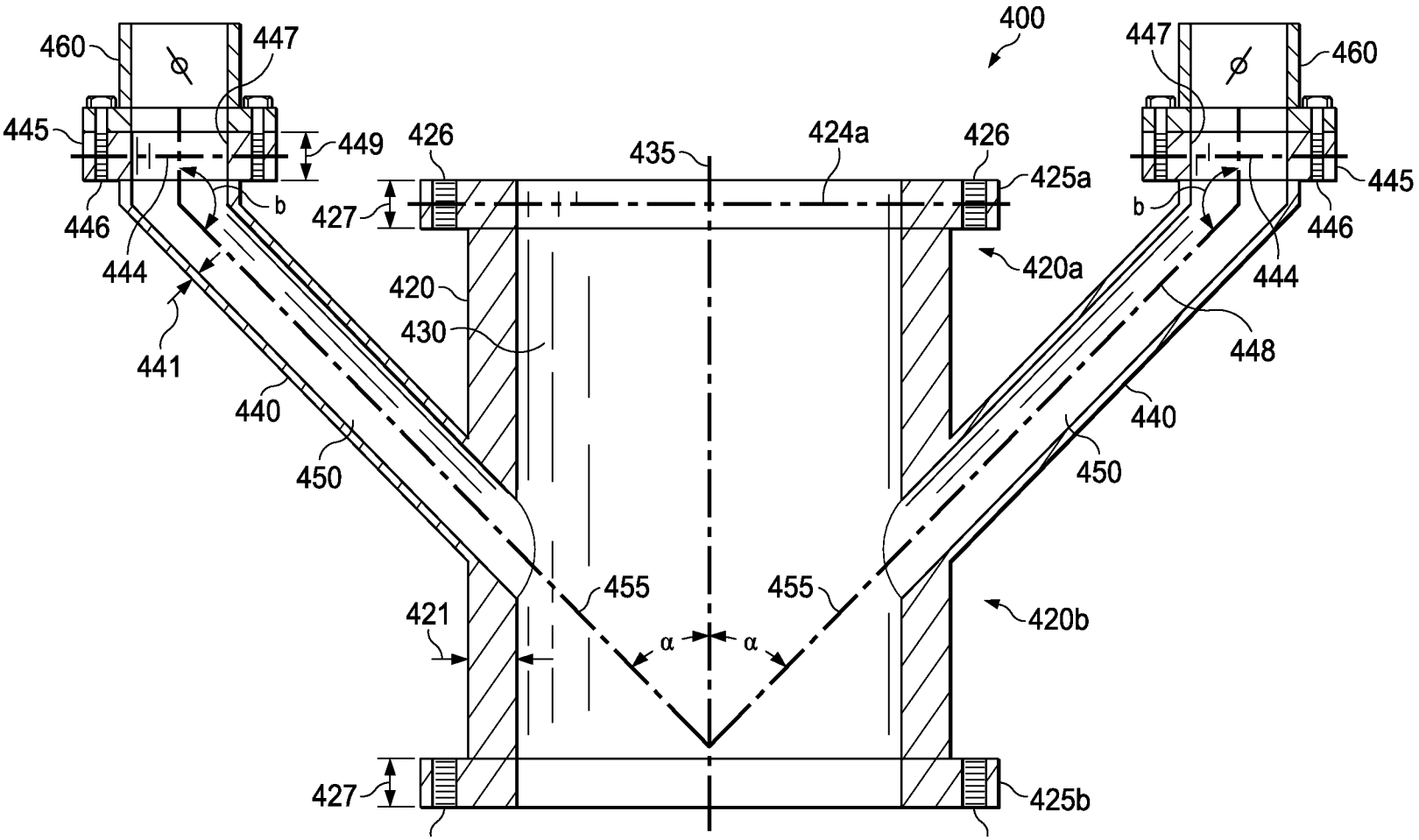
FIG. 3 is a cross-sectional view of the diverter spool of FIGS. 1A, 1B, and 1C having valves connected to the side outlets thereof.

Referring to FIG. 3, in an embodiment one or more of the secondary connection assemblies 445 may be fitted with and/or connected to a valve 460. The valve 460 may comprise any suitable type and/or configuration of valve. Suitable types and configurations of valves include, but are not limited to, a ball valve, a butterfly valve, a disc valve, a choke valve, a gate valve, a spool valve, or the like. In an embodiment, the valve 440 may be configured for hydraulic, pneumatic, manual, solenoid, mechanized, or motorized operation. In a particular embodiment, the valve 440 may be configured for operation via an ROV.

In an embodiment, the secondary connector assemblies 445 may intersect the side outlets 440 at an angle. Referring to FIG. 2, each of the secondary connector assemblies 445 intersects the associated side outlet 440 such that the longitudinal central axis 448 of the flowbore 447 of the secondary connector assembly 445 is not coaxial with the longitudinal central axis 455 of the side outlets 440. In the embodiment of FIG. 2, an angle, designated as b, formed at the intersection of the i) longitudinal central axis 455 of the secondary flowbore 450 and ii) the longitudinal central axis 448 of the flowbore 447 of the secondary connector assembly 445 may be less than 170°, alternatively, less than about 160°, alternatively, less than about 150°, alternatively, less than about 120°, alternatively, less than about 110°.

In an embodiment, the side outlets 440 and/or the components thereof may be formed in a suitable thickness. For example, in an embodiment the thickness of the walls 441 of the side outlets 440 may be in a range of from about 1.00 in. to about 6.500 in., alternatively, from about 1.250 to about 5.00 in., alternatively, from about 1.50 to about 4.50 in. In an embodiment, the thickness of a wall may be dependent upon and/or related to in the inner diameter of the body 420 and/or the inner diameter of the side outlets 440. Also, in an embodiment the thickness 449 of the secondary connector assemblies 445 may be in a range of from about 1.00 in. to about 6.500 in., alternatively, from about 1.250 to about 5.00 in., alternatively, from about 1.50 to about 4.50 in. In an embodiment, the thickness of a connection assembly may be dependent upon and/or related to in the inner diameter of the body 420 and/or the inner diameter of the side outlets 440.

In an embodiment, the side outlets 440 and the secondary connector assemblies 445 may have a suitable length. For example, in an embodiment the side outlets 440 may extend away from the body 420 a length in the range from about 6 in. to 48 in., alternatively, from about 12 in. to about 36 in., alternatively, from about 18 in. to about 30 in. In an embodiment, the length of the side outlets may be dependent upon and/or related to in the inner diameter of the body 420 and/or the inner diameter of the side outlets 440. Also, in an embodiment the secondary connector assemblies 445 may extend upward or downward from the end of the sides outlets 440 a suitable distance. For example, referring to the embodiment of FIGS. 2 and 3, the secondary connector assemblies 445 extend upward such that a centerline 444 of the secondary connector assemblies 445 is at an elevation above a centerline 424*a* of the upper connection assembly 425*a*. Alternatively, the secondary connector assemblies 445 and/or the side outlets 440 may be configured such that the centerline 444 of the secondary connector assemblies 445 is at an elevation below the centerline 424*a* of the upper connection assembly 425*a*, alternatively, such that the centerline 444 of the secondary connector assemblies 445 is at an elevation about the same as that of the centerline 424*a* of the upper connection assembly 425*a*.

In an embodiment, the secondary flowbores 450 (e.g., the flowbores of the side outlets 440) may be characterized as having a total flow area (e.g., the total flow area of all side outlets present) of at least about 75%, alternatively, at least about 80%, alternatively, at least about 85%, alternatively, at least about 90%, alternatively, at least about 95% of the flow area of the primary flowbore 430. Not intending to be bound by theory, it is theorized that the capability of the diverter spool to disperse fluid pressure and/or fluid flow may be improved where the flow area of the secondary flowbores 450 approaches or exceeds the flow area of the primary flowbore 430.

In an embodiment, the body 420 and the side outlets 440 may be configured such that at least about 75%, alternatively, at least about 80%, alternatively, at least about 85%, alternatively, at least about 90%, alternatively, at least about 95% of the volume of the fluid that enters the diverter spool 400 may expelled therefrom via the side outlets 440 while the average fluid velocity within the secondary flowbores 450 is not more than about 125%, alternatively, not more than about 120%, alternatively, not more than about 115%, alternatively, not more than about 110%, alternatively, not more than about 105%, alternatively, not more than about 100%, of the average fluid velocity in the primary flowbore 430. Not intending to be bound by theory, it is theorized that the capability of the diverter spool to disperse fluid pressure and/or fluid flow may be improved where the volume of fluid flowing within the secondary flowbores 450 approaches or equals the volume of fluid flowing within the primary flowbore 430 while the flowrate in the secondary flowbores 450 does not greatly exceed the flow rate within the primary flowbore 430.

In an embodiment, the diverter spool 400 may be configurable, by altering one or more of the parameters disclosed herein, for use in wide-ranging circumstances. For example, the size of the flowbores (e.g., the primary flowbore 430 and/or the secondary flowbore 450), the angle at which the side outlets 440 intersect the body 420, the length of the side outlets 440, the angle of the connection assemblies 425 with respect to the body 420, the angle of the secondary connection assemblies 445 with respect to the side outlets 440, the pressure thresholds exhibited by the diverter spool 400, or combinations thereof may be varied to meet a particular circumstance.

One or more embodiments of a diverter spool (e.g., diverter spool 400) and a WCA (e.g., WCA 200) having been disclosed, also disclosed herein are one or more embodiments of methods of containing a well employing such a diverter spool and/or a well containment assembly. In an embodiment, such a well containment method may generally comprise the steps of preparing a well in need of containment for connection to a well containment assembly comprising a diverter spool, placing a WCA in proximity to the well such that at least a portion of the fluid escaping from the well the is directed into the WCA, connecting the WCA to the well, and suppressing fluid flow through at least a portion of the WCA.

In an embodiment, a well in need of containment may be prepared for connection to a WCA 200 by removing damaged components and providing a connection with which the WCA 200 may be mated. For example, where a component of a well has been damaged, has lost integrity, is defective, or otherwise fails to contain a fluid emitted from a well, it may be necessary to remove all or a portion of the inoperable or damaged component. Examples of such components as may necessitate removal include, but are not limited to, a riser, a wellhead, a production tubing joint, a BOP stack, or combinations thereof. Referring again to the embodiment of FIG. 1A, where the defective components have been removed, a subsea wellhead 150 will provide the well component to which the WCA 200 will be connected to contain the well. It is noted that although the embodiment of FIGS. 1A, 1B, and 1C illustrate a flanged connection between the WCA 200 and the wellhead 150, a similar WCA may be connected to various other well components via any suitable type and/or configuration of connection. In the embodiment of FIG. 1A, a stream 151 of well fluids is shown emitted from the wellhead 150 following removal of inoperable or damaged components. As will be appreciated by one of skill in the art, the stream 151 may be characterized as a relatively high-pressure, high-flow-rate fluid stream, as will be discussed herein.

In an embodiment where the well to be contained is located beneath a body of water, such as body of water 120, at least a portion of the process of preparing the well for connection to the WCA 200 may be performed remotely via the operation of ROVs, lifting cranes, or other equipment conventionally employed to perform such tasks.

In the embodiment of FIGS. 1A, 1B, and 1C, the WCA 200 may be placed in proximity to the wellhead 150 suspended from a lower end of the tubing string 140. The tubing string 140 may comprise axial flowbore 141. The WCA 200 may be attached to the tubing string 140 such that the axial flowbore 141 is in fluid communication with the flowbores through the WCA (e.g., flowbore through the PCDs and/or the diverter spool). Not intending to be bound by theory, the WCA may be characterized as very heavy and, as such, may be suspended from a relatively high-strength tubing string 140, such as the drilling string. In alternative embodiments, a WCA may be suspended via a cable, a plurality of wirelines, composite ropes, or the like.

In an embodiment, the drilling sting 140 may comprise an obstructing device (e.g., a valve, "blank," or "blind") 143 configured to restrict and/or prevent the flow of well fluids upward through the flowbore 141 of the tubing string 140 during positioning of the WCA 200. In an embodiment, the tubing string 140 may also comprise a plurality of ports and/or windows 142 configured to disperse fluid pressure from the axial flowbore 141 of the tubing string 140, for example, positioned between a PCD 300 and the obstructing device 143.

In an embodiment, the WCA 200 may be brought into proximity with the wellhead 150 with all valves and/or the like within the WCA 200 (e.g., actuatable valves or devices of the PCDs 300 and/or the diverter spool) in an open configuration. For example, the WCA 200 may be configured such that the WCA 200 will allow any fluid that flows into the WCA 200 to be emitted therefrom via ports/windows 142 and/or side outlets 440.

In an embodiment, the WCA 200 may be positioned in proximity to the wellhead 150 such that at least a portion of the fluid stream 151 emitted from the well is directed into the WCA 200, for example, by coaxially aligning the lowermost portion of the flowbore 301 with the fluid stream 151 (approximately coaxial with wellhead 150). Alternatively, in an embodiment where a diverter spool like diverter spool 400 comprises the lowermost component of a WCA, the primary flowbore 430 of the diverter spool 400 may be similarly coaxially aligned with the fluid stream 151 (approximately coaxial with wellhead 150). Referring to FIG. 1B, as the WCA 200 is placed coaxially with the fluid stream 151, at least a portion of the fluid stream 151 flows into the WCA 200 and is emitted therefrom via the side outlets 440 of the diverter spool 400 and/or the ports/windows 142 of the tubing string 140. In an alternative embodiment where such ports/windows 142 are absent from the tubing string 140, the fluid may be emitted only from the side outlets 440 of the diverter spool. As will be appreciated by one of skill in the art, positioning the WCA 200 in proximity to the wellhead 150 may be complicated by the fluid stream 151. For example, the high pressures and/or high-flow-rate of the fluid stream 151 may cause difficulty in positioning the WCA 200 over the wellhead 150 in that the fluid stream 151 may tend to act on the WCA 200, pushing the WCA 200 away from the wellhead 150.

It is appreciated that, in an embodiment, the wellhead 150 or the well component to which the WCA 200 will be connected may deviate from a perfectly vertical orientation, particularly in cases where well components have been damaged. In such an embodiment, it may be advantageous to configure the diverter spool 400 (e.g., as disclosed herein) and/or other components of the WCA 200 to aid in connecting to the wellhead 150 and/or to allow for access to the diverter spool 400 and/or the WCA 200 following connection to the well.

In an embodiment, with the WCA 200 positioned in proximity to the wellhead 150, the WCA 200 and the wellhead 150 may be secured via a suitable connection. For example, in an embodiment where the lower portion of the WCA 200 and the wellhead 150 each comprise flanges, the flanges may be secured by a plurality of bolts, clamps, or the like. Suitable alternative connections may be appreciated by one of skill in the art viewing this disclose. Examples of such alternatives connections include but are not limited to collet connectors or hydraulically controlled squeeze lock contraptions.

In an embodiment, with the WCA 200 secured to the wellhead 150, the fluid flow through and/or out of the WCA 200 may be curtailed and/or ceased. In an embodiment, the fluid emitted from the side outlets 440 of the diverter spool 400 may be ceased by actuating a valve (e.g., valves 460) attached to each of the side outlets. In an embodiment, the valve 460 may be connected to the side outlets 440 before the WCA 200 is lowered into the body of water 120, alternatively, the valve 460 may be connected to the side outlets 440 after the WCA 200 has been positioned with respect to the wellhead 150 and secured thereto. In an embodiment, the valves may be actuated via the operation of an ROV like ROV 500. In another embodiment, the fluid flowing via the flowbore 301 extending through the PCDs 300 may be ceased by actuating one or more of the PCDS 300. The choice of which fluid movement should be ceased and the sequence thereof may be determined based upon objectives and considerations as will be apparent to one of skill in the art viewing this disclosure.

A WCA and/or a diverter spool of the type disclosed herein may be advantageously employed in the performance of well containment processes as described herein. For example, a diverter spool such as diverter spool 400 may allow fluid to efficiently be dispersed while a WCA like WCA 200 is connected to a well component (e.g., wellhead 150 as disclosed herein). As disclosed herein, the massive pressures and volumes of fluid escaping from an uncontrolled well make it difficult to connect another component thereto and, thereby, difficult to bring the well under control. That is, if the fluid and/or the pressure is not dissipated, the pressure and or fluid may cause it to be nearly impossible to position a WCA with respect to an open well in that the stream of fluid may tend to eject objects from its path. A diverter spool as disclosed herein allows such fluid and/or fluid pressure to be efficiently dissipated, thereby making connection of the WCA 200 possible.

Further, the diverter spool 400 may also improve the ability to make a connection to the WCA 200 by moving at least a portion of the fluids away from the immediate proximity of the connection. Often, and particularly in subsea embodiments, connecting a WCA to an open well is further complicated by the fact that, if the escaping fluid is not allowed to be removed from the site of the connection, visibility may be decreased to the point that it is difficult, if not impossible for work to progress. In an embodiment, the diverter spool 400 allows at least a portion of the fluid escaping an open well to be carried away from the immediate site of the connection and dissipated elsewhere (e.g., above the site of the connection between the WCA 200 and the wellhead 150).

ADDITIONAL DISCLOSURE

The following are nonlimiting, specific embodiments in accordance with the present disclosure:

Embodiment A. A well containment assembly comprising:

a first pressure-containing device; and a diverter spool, the diverter spool comprising:

a body having a longitudinal central axis and at least partially defining a primary flowbore;

an upper connection assembly coupled to the body;

a lower connection assembly coupled to the body; and a plurality of side outlets, each of the plurality of side outlets having a longitudinal central axis and at least partially defining a secondary flowbore;

wherein each of the plurality secondary flowbores are in communication with the primary flowbore, and wherein the angle between the longitudinal central axis of the body and the longitudinal central axis of the plurality of side outlets is less than 90° with respect to the primary flowbore, wherein the first pressure-containing device is coupled to the diverter spool via the upper connection assembly.

Embodiment B. The well containment assembly of Embodiment A, wherein at least one of the plurality of side outlets extends toward the upper connection assembly and wherein the angle between the longitudinal central axis of the body and the longitudinal central axis of the plurality of side outlets is less than 80°.

Embodiment C. The well containment assembly of Embodiment A, wherein at least one of the plurality of side outlets extends toward the lower connection assembly and wherein the angle between the longitudinal central axis of the body and the longitudinal central axis of the plurality of side outlets is less than 80°.

Embodiment D. The well containment assembly of one of Embodiments A through C, wherein the total flow area of the secondary flowbores is at least 75% of the flow area of the primary flowbore.

Embodiment E. The well containment assembly of one of Embodiments A through D, wherein the total flow area of the secondary flowbores is at least 90% of the flow area of the primary flowbore.

Embodiment F. The well containment assembly of one of Embodiments A through E, wherein the total flow area of the secondary flowbores is such that at least 80% of a volume of fluid entering the diverter spool is expelled therefrom via the secondary flowbores.

Embodiment G. The well containment assembly of one of Embodiments A through F, wherein the average fluid velocity within the secondary flowbores is less than 120% of the average fluid velocity with the primary flowbore.

Embodiment H. The well containment assembly of one of Embodiments A through G, wherein each of the plurality of side outlets further comprises a secondary connection assembly coupled to a terminal portion of each of the plurality of side outlets.

Embodiment I. The well containment assembly of one of Embodiments A through H, wherein the upper connection assembly, the lower connection assembly, or both comprises a flange.

Embodiment J. The well containment assembly of Embodiment H, wherein at least one of the secondary connection assemblies comprises a flange.

Embodiment K. The well containment assembly of one of Embodiments A through J, further comprising a valve coupled to at least one of the plurality of side outlets.

Embodiment L. The well containment assembly of one of Embodiments A through K, wherein the diverter spool is characterized as able to withstand a fluid pressure of at least 10,000 psi.

Embodiment M. A method of containing a well comprising:

providing a well containment assembly comprising:

a first pressure-containing device; and a diverter spool, the diverter spool comprising:

a body having a longitudinal central axis and at least partially defining a primary flowbore;

an upper connection assembly coupled to the body;

a lower connection assembly coupled to the body; and a plurality of side outlets, each of the side outlets having a longitudinal central axis and at least partially defining a secondary flowbore;

wherein the each of the secondary flowbores are in communication with the primary flowbore, and wherein the angle between the longitudinal central axis of the body and the longitudinal central axis of the plurality of side outlets is less than 90° with respect to the primary flowbore, wherein the first pressure-containing device is coupled to the diverter spool via the upper connection assembly;

placing the well containment assembly in close proximity to an open well such that at least a portion of a fluid escaping from the well is directed into the well containment assembly, and wherein at least a portion of the volume of the fluid directed into the well containment assembly is expelled therefrom via the plurality of side outlets; and connecting the well containment assembly to the well.

Embodiment N. The method of containing a well of Embodiment M, wherein the each of the plurality of side outlets further comprises a valve coupled to a terminal portion of each of the plurality of side outlets.

Embodiment O. The method of containing a well of Embodiment N, further comprising closing each of the valves.

Embodiment P. The method of containing a well of one of Embodiments M through O, wherein at least 75% of the volume of the fluid directed into the well containment assembly is expelled therefrom via the plurality of side outlets.

Embodiment Q. The method of containing a well of one of Embodiments M through P, wherein at least 90% of the volume of the fluid directed into the well containment assembly is expelled therefrom via the plurality of side outlets.

Embodiment R. The method of containing a well of one of Embodiments M through Q, wherein connecting the well containment assembly to the well comprises making a flanged connection.

Embodiment S. The method of containing a well of Embodiment O, wherein a remotely operated vehicle is employed to place the well containment assembly, to connect the well containment assembly, to close one or more valves, or combinations thereof.

Embodiment T. The method of containing a well of one of Embodiments M through S, wherein at least one of the plurality of side outlets extends toward the upper connection assembly and wherein the angle between the longitudinal central axis of the body and the longitudinal central axis of the plurality of side outlets is less than 80°.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims.

Each and every claim is incorporated as further disclosure into the specification and the claims are embodiment(s) of the present invention.

What is claimed is:

1. A well containment system comprising:

a wellhead; and a well containment assembly, the well containment assembly including:

a first pressure-containing device; and a diverter spool, the diverter spool comprising:

a body having a longitudinal central axis and at least partially defining a primary flowbore;

an upper connection assembly coupled to the body;

a lower connection assembly coupled to the body; and a plurality of side outlets, each of the plurality of side outlets having a longitudinal central axis and at least partially defining a secondary flowbore;

wherein each of the plurality secondary flowbores are in communication with the primary flowbore, and wherein the angle between the longitudinal central axis of the body and the longitudinal central axis of the plurality of side outlets is less than 90° with respect to the primary flowbore, wherein the first pressure-containing device is coupled to the diverter spool via the upper connection assembly, and wherein the well containment assembly is connected to the wellhead via the lower connection assembly.

2. The well containment system of claim 1, wherein at least one of the plurality of side outlets extends toward the upper connection assembly and wherein the angle between the longitudinal central axis of the body and the longitudinal central axis of the plurality of side outlets is less than 80°.

3. A well containment assembly comprising:

a first pressure-containing device; and a diverter spool, the diverter spool comprising:

a body having a longitudinal central axis and at least partially defining a primary flowbore, an upper connection assembly coupled to the body;

a lower connection assembly coupled to the body; and a plurality of side outlets, each of the plurality of side outlets having a longitudinal central axis and at least partially defining a secondary flowbore, wherein at least one of the of the plurality of side outlets extends toward the lower connection assembly and wherein the angle between the longitudinal central axis of the body and the longitudinal central axis of the plurality of side outlets is less than 80° with respect to the primary flowbore, wherein each of the plurality secondary flowbores are in communication with the primary flowbore, and wherein the first pressure-containing device is coupled to the diverter spool via the upper connection assembly.

4. The well containment system of claim 1, wherein the total flow area of the secondary flowbores is at least 75% of the flow area of the primary flowbore.

5. The well containment system of claim 1, wherein the total flow area of the secondary flowbores is at least 90% of the flow area of the primary flowbore.

6. The well containment system of claim 1, wherein the total flow area of the secondary flowbores is such that at least 80% of a volume of fluid entering the diverter spool is expelled therefrom via the secondary bores.

7. The well containment system of claim 6, wherein the average fluid velocity within the secondary flowbores is less than 120% of the average fluid velocity within the primary flowbore.

8. The well containment system of claim 1, wherein each of the plurality of side outlets further comprises a secondary connection assembly coupled to a terminal portion of each of the plurality of side outlets.

9. The well containment system of claim 8, wherein at least one of the secondary connection assemblies comprises a flange.

10. The well containment system of claim 1, wherein the upper connection assembly, the lower connection assembly, or both comprises a flange.

11. The well containment system of claim 1, further comprising a valve coupled to at least one of the plurality of side outlets.

12. The well containment system of claim 1, wherein the diverter spool is characterized as able to withstand a fluid pressure of at least 10,000 psi.

13. A method of containing a well comprising:

providing a well containment assembly comprising:

a first pressure-containing device; and a diverter spool, the diverter spool comprising:

a body having a longitudinal central axis and at least partially defining a primary flowbore;

an upper connection assembly coupled to the body;

a lower connection assembly coupled to the body; and a plurality of side outlets, each of the side outlets having a longitudinal central axis and at least partially defining a secondary flowbore;

wherein the each of the secondary flowbores are in communication with the primary flowbore, and wherein the angle between the longitudinal central axis of the body and the longitudinal central axis of the plurality of side outlets is less than 90° with respect to the primary flowbore, wherein the first pressure-containing device is coupled to the diverter spool via the upper connection assembly;

placing the well containment assembly in close proximity to an open wellhead such that at least a portion of a fluid escaping from the wellhead is directed into the well containment assembly, and wherein at least a onion of the volume of the fluid directed into the well containment assembly is expelled therefrom via the plurality of side outlets; and connecting the well containment assembly to the wellhead.

14. The method of containing a well of claim 13, wherein the each of the plurality of side outlets further comprises a valve coupled to a terminal portion of each of the plurality of side outlets.

15. The method of containing a well of claim 14, further comprising closing each of the valves.

16. The method of containing a well of claim 15, wherein a remotely operated vehicle is employed to place the well containment assembly, to connect the well containment assembly, to close one or more valves, or combinations thereof.

17. The method of containing a well of claim 13, wherein at least 75% of the volume of the fluid directed into the well containment assembly is expelled therefrom via the plurality of side outlets.

18. The method of containing a well of claim 13 wherein at least 90% of the volume of the fluid directed into the well containment assembly is expelled therefrom via the plurality of sale outlets.

19. The method of containing a well of claim 13, wherein connecting the well containment assembly to the well comprises making a flanged connection.

20. The method of. containing a well of claim 13, wherein at least one of the plurality of side outlets extends toward the upper connection assembly and wherein the angle between the longitudinal central axis of the body and the longitudinal central axis of the plurality of side outlets is less than 80°.

* * * * *